US005523009A

United States Patent [19]

Root et al.

[11] Patent Number: 5,523,009

[45] Date of Patent: Jun. 4, 1996

[54] FIBROUS POLYUREA GREASE

[75] Inventors: Jon C. Root, Leawood, Kans.; Mark Baum, Kansas City; Walter Leslie, Raytown, both of Mo.

[73] Assignee: Witco Corporation, Greenwich, Conn.

[21] Appl. No.: 407,971

[22] Filed: Mar. 22, 1995

[51] Int. Cl.[6] ..... C10M 115/08

[52] U.S. Cl. ..... 252/57.5 R; 252/51.5 A

[58] Field of Search ..... 252/51.5 R, 51.5 A

[56] References Cited

U.S. PATENT DOCUMENTS 4,668,411 5/1987 Yasui et al. .

4,780,231 10/1988 Kinoshita et al. .

5,011,617 4/1991 Fagan ..... 252/51.5 R 5,238,589 8/1993 Pratt et al. ..... 252/51.5 R 5,301,923 4/1994 Asao et al. ..... 252/51.5 R

*Primary Examiner*—Jacqueline V. Howard

*Attorney, Agent, or Firm*—Lockwood, Alex, Fitzgibbon & Cummings

[57] ABSTRACT

A fibrous grease comprising a base oil and a fibrous diurea thickener comprising the reaction product of toluene diisocyanate, a fatty aliphatic amine and an alkylphenyl amine.

14 Claims, No Drawings

FIBROUS POLYUREA GREASE

BACKGROUND AND DESCRIPTION OF THE INVENTION

This invention relates to a fibrous grease comprising a base oil and a diurea thickener comprising the reaction product of toluene diisocyanate, a fatty aliphatic amine and an alkylphenyl amine. More particularly, this invention relates to a fibrous grease comprising a base oil and a first diurea thickener comprising the reaction product of toluene diisocyanate, a fatty aliphatic amine and an alkylphenyl amine and a second thickener comprising the reaction product of toluene diisocyanate, cycloalkyl amine and a fatty aliphatic amine.

Numerous greases have been developed over the years for various purposes. So-called fibrous barium greases, which are tacky and sticky, have been used because of their high service tension to prevent metal to metal contact in trailer hitches and railroad couplings. These barium greases have been banned in some places to prevent their disposal compromising the environment. While these fibrous barium greases have been generally satisfactory for their intended use, they also have the disadvantage that they bleed when used at elevated temperatures and tend to stiffen on storage in containers. Accordingly, there is a need for more environmentally acceptable fibrous greases.

Yasui et al. 4,668,411 discusses the pros and cons of various diurea greases at column 1, line 43, through column 2, line 5. Briefly, the reference states that dihydrocarbyl ureas have the drawback that if (1) both hydrocarbyl groups are alkyl of at least 12 carbon atoms the grease markedly softens and is therefore unusable at high temperatures, (2) both hydrocarbyl groups are alkyl of up to 11 carbon atoms the grease is fibrous and liable to shatter under high speed conditions and has a shortened life, and (3) if one of the hydrocarbyl groups is aromatic or an alicyclic ring, the grease has poor mechanical stability under high-temperature conditions, leaks markedly and has a shortened life. The patentee then alleges better properties if one hydrocarbyl groups is cyclohexyl and the other monoalkylphenyl containing 8 to 16 carbon atoms in the alkyl groups. Kinoshita et al. 4,780,231 is more or less cumulative to Yasui et al. but alleges better properties if the diurea is formed from a primary amine and a secondary amine and at least one amine contains a cyclohexyl group.

The general object of this invention is to provide a barium free fibrous grease. A more specific object of this invention is to provide a barium free fibrous grease, which has less tendency to bleed than fibrous barium greases and reduced tendency to stiffen in containers. Other objects appear hereinafter.

The general object of this invention can be attained with a fibrous grease comprising a base oil and a diurea thickener comprising the reaction product of toluene diisocyanate, a fatty aliphatic amine and an alkylphenyl amine. Greases consisting essentially of these two components are fibrous and have a high drop point making them suitable for replacement of fibrous barium greases. When the thickener comprises a first diurea comprising the reaction product of toluene diisocyanate, a fatty aliphatic amine and an alkylphenyl amine and a second diurea thickener comprising the reaction product of toluene diisocyanate, cycloalkyl amine and fatty aliphatic amine, the grease is fibrous, has a high drop point, is resistant to high temperature bleeding and does not stiffen during storage in containers. All of the greases of this invention can be used to prevent metal to metal contact in trailer hitches and railroad couplings.

Briefly, the essential fibrous diurea thickener useful in this invention can be prepared by reacting in a base oil toluene diisocyanate, a fatty aliphatic amine and an alkylphenyl amine.

Suitable fatty aliphatic amines useful in this invention are $C_8$ to $C_{20}$ alkyl amines, such as n-octyl amine, 2-ethylhexyl amine, hexadecyl amine, octadecyl amine, tallow amine (mixture of $C_{16}$ and $C_{18}$ alkyl amines), hydrogenated tallow amine, alkenyl amines, such as oleyl amines, etc.

Suitable alkylphenyl amines useful in this invention include ortho, meta or para $C_1$ to $C_4$ alkylphenyl amines such as ortho or para toluidine, para-ethylaniline, para-isopropylaniline, para-tert-butylaniline, ortho-n-butylaniline, etc.

The fibrous diurea can have a mole ratio of fatty aliphatic amine to alkylphenyl amine of about 9:1 to 1:9, preferably 2:3 to 3:2. Best results have been obtained using substantially equivalent amounts of fatty aliphatic amine and alkylphenyl amine.

Commercial toluene diisocyanate, which is a mixture of 2,4 and 2,6-diisocyanate, is the preferred toluene diisocyanate.

Suitable base oils or fluids useful in this invention include any oils commonly used as lube base oils, such as mineral oil, polybutene, synthetic, vegetable oil, animal oil, etc.

The fibrous diurea can be prepared by reacting about 0.5 to 1.5 equivalents of amines per equivalent of diisocyanate in oil or fluid and heating same until they form a gel. For example the diisocyanate and amines can be dispersed or suspended separately in oil and then the two dispersions or suspensions mixed together and heated at about 100° F. to 350° F. until they form a diurea gel.

As indicated above, the fibrous diurea or first diurea thickener is preferably used in conjunction with a second diurea thickener comprising the reaction product of toluene diisocyanate, cycloalkyl amine and a fatty aliphatic amine.

The toluene diisocyanate and fatty aliphatic amine suitable for forming the second diurea thickener can be any of those used to form the first or fibrous diurea thickener and preferably the same compounds are used in each thickener.

Suitable cycloalkyl amines for forming the second diurea thickener include cyclohexyl amine, methylcyclohexyl amine, ethylcyclohexyl amine, N,N-dicyclohexyl amine, etc.

The second diurea thickener can have a mole ratio of fatty aliphatic amine to cycloalkyl amine of about 9:1 to 1:9, preferably 2:3 to 3:2. Best results have been obtained using substantially equivalent amounts of fatty aliphatic amine and cycloalkyl amine.

The second diurea thickener can be prepared by reacting about 0.5 to 1.5 equivalents of amine per equivalent of diisocyanate in oil or fluid and heating same until they form a gel preferably under shear. For example the diisocyanate and amine can each be dispersed or suspended separately in oil and then the two dispersions or suspensions mixed together and heated to about 100°F. to 350° F. until they form a diurea gel.

The first and second diurea thickeners can be made separately and then blended together with more base oil, if desired. Alternatively, either the first or second diurea thickener can be made in the presence of the other. Best results have been attained by preparing the fibrous or first thickener in a dispersion of the second diurea thickener and then adding additional base oil.

For example, a fibrous grease comprising a base oil and a fibrous or first diurea thickener and a second diurea thickener can be prepared by (1) reacting a base oil dispersion of toluene diisocyanate, cycloalkyl amine and a fatty aliphatic amine (preferably equal molar concentrations of toluene diisocyanate, cycloalkyl amine and fatty aliphatic amine) until substantially all of the isocyanate groups have reacted to form a diurea thickener, (2) dispersing fatty aliphatic amine and alkylphenyl amine in the reaction product of step (1), (3) then adding toluene diisocyanate to the dispersion of step (2) (preferably equal molar quantities of toluene diisocyanate, fatty aliphatic amine and alkylphenyl amine are used in steps 2 and 3) and reacting until substantially all the isocyanate groups have reacted to form a fibrous diurea thickener insitu.

The weight ratio of fibrous or first diurea thickener to second diurea thickener can advantageously be from 1:1 to 19:1, preferably 2:1 to 9:1.

In any event, the diurea blend is agitated until the polyurea grease has the desired consistency. Either before or after agitation at 100° F. to 350° F. under shear, the diurea thickeners can be diluted with base oil or fluid to about 2 to 15 weight percent diurea.

Any conventional additives can then be added, such as another thickener, an extreme pressure additive, an antioxidant, a rust inhibitor, a viscosity index improver, etc.

EXAMPLE 1

After a dispersion of 100.8 parts by weight toluene diisocyanate in 4,320 parts by weight 750 SUS viscosity oil was heated to 120° F., 57.6 parts by weight cyclohexyl amine was added slowly followed by 152.4 parts by weight tallow amine and the temperature was maintained at 120°F. to 135° F. until substantially all the toluene diisocyanate reacted (I.R. showed no peak at about $2270^{+1}$cm). There was then added with stirring at 120° F. to 135° F., 2,586 parts by weight 750 SUS viscosity oil, 219.6 parts by weight paratoluidine and 614.4 parts by weight tallow amine forming a smooth dispersion of amine in the first diurea oil thickened composition. Four hundred nine parts by weight toluene diisocyanate was slowly added while maintaining the temperature at 120° F. to 135° F. After the temperature was raised to 310° F. to 320°F, there was added 1,800 parts by weight 750 SUS viscosity oil, 1,200 parts by weight $CaCO_3$, 360 parts by weight clay treated with sodium nitrite, 60 parts by weight alkylated diphenylamine and 120 parts by weight $MoS_2$ forming an excellent fibrous diurea grease.

The fibrous grease was tested against a barium fibrous grease and the results are set forth below in Table I.

TABLE I

| Test | ASTM Method | Fibrous Polyurea | Barium |
|---|---|---|---|
| Density (lbs/gal) | | 7.78 | 7.76 |
| Penetration @ 77° F. | D-217 | | |
| Worked 60 Strokes | | 278 | 275 |
| Worked 10,000 (change) | | 346 (+68) | 321 (+46) |
| Worked 100,000 (change) | | 372 (+94) | 380 (+105) |
| Undisturbed (change) | | 320 (+42) @ 24 hrs | 370 (+95) @ 24 hrs |
| Worked 100,000 w/10% water (change) | | 340 (+62) | 375 (+100) |
| Bethlehem Steel Test Worked 60X (change) | | 330 (+52) | Fluid |
| Roll Stability (change) | D-1831 | 330 (+52) | 300 (+25) |
| Rust Protection | D-1743 | Pass | Fail |
| Dropping Point, °F. | D-2265 | 580 | 411 |

TABLE I-continued

| Test | ASTM Method | Fibrous Polyurea | Barium |
|---|---|---|---|
| Water Washout @ 176° F., % | D-1264 | 13.8 | 19.7 |
| Oil Separation, % Loss | D-1742 | 0.2 | 0.01 |
| Base Oil Characteristics | | | |
| Vis @ 40° cSt | D-445 | 146.6 | 146.6 |
| Vis @ 100° cSt | D-445 | 11.64 | 11.64 |
| Viscosity Index | D-2270 | 51 | 51 |
| Lincoln Ventmeter | D-4049 | | |
| @ 74° F. | | 250 psi | 300 psi |
| @ 0° F. | | 1800 psi | 1800 psi |
| Copper Corrosion | D-4048 | 1B | 1B |
| Low Temp Torque-Wheel Bearing, Nm | D-4693 | 21.0 | 24.0 |
| Fretting Protection, mg loss | D-4170 | 2.3 | 7.6 |

We claim:

1. A fibrous grease comprising a base oil and a fibrous diurea thickener comprising the reaction product of toluene diisocyanate, a $C_8$ to $C_{20}$ fatty aliphatic amine and a $C_1$ to $C_4$ alkylphenyl amine.

2. The grease of claim 1, wherein the mole ratio of fatty aliphatic amine to alkylphenyl amine in the fibrous diurea thickener is from 9:1 to 1:9.

3. The grease of claim 1, wherein the mole ratio of fatty aliphatic amine to alkylphenyl amine in the fibrous diurea thickener is from 2:3 to 3:2.

4. The grease of claim 3, wherein the fatty aliphatic amine comprises at least one member selected from the group consisting of tallow amine, hydrogenated tallow amine and oleyl amine.

5. A fibrous grease comprising a base oil and a first diurea thickener comprising the reaction product of toluene diisocyanate, a $C_8$ to $C_{20}$ fatty aliphatic amine and a $C_1$ to $C_4$ alkylphenyl amine and a second diurea thickener comprising the reaction product of toluene diisocyanate, cyclohexyl amine and a $C_8$ to $C_{20}$ fatty aliphatic amine.

6. The grease of claim 5, wherein the weight ratio of first diurea thickener to second diurea thickener is from 1:1 to 19:1.

7. The grease of claim 6, wherein the mole ratio of fatty aliphatic amine to alkylphenyl amine in the first diurea thickener is from 9:1 to 1:9 and the mole ratio of fatty aliphatic amine to cycloalkyl amine in the second diurea thickener is from 9:1 to 1:9.

8. The grease of claim 7, wherein the mole ratio of fatty aliphatic amine to alkylphenyl amine in the first diurea thickener is from 2:3 to 3:2.

9. The grease of claim 8 wherein the mole ratio of fatty aliphatic amine to cycloalkyl amine in the second diurea thickener is from 2:3 to 3:2 and the cycloalkyl amine comprises cyclohexyl amine.

10. The grease of claim 9, wherein the fatty aliphatic amine in the first diurea thickener and in the second diurea thickener comprises at least one member selected from the group consisting of tallow amine, hydrogenated tallow amine and oleyl amine.

11. The grease of claim 10, wherein there are substantially equal molar concentrations of alkylphenyl amine, fatty aliphatic amine and toluene diisocyanate in the first diurea thickener reaction product and substantially equal molar concentrations of cyclohexyl amine, fatty aliphatic amine and toluene diisocyanate in the second diurea thickener reaction product.

12. The method of preparing a fibrous diurea grease comprising a base oil and a fibrous or first diurea thickener and a second diurea thickener which comprises the steps of (1) reacting a base oil dispersion of toluene diisocyanate, cycloalkyl amine and $C_8$ to $C_{20}$ fatty aliphatic amine until substantially all of the isocyanate groups have reacted to form a diurea thickener, (2) dispersing $C_8$ to $C_{20}$ fatty aliphatic amine and $C_1$ to $C_4$ alkylphenyl amine in the reaction product of step (1), (3) adding toluene diisocyanate to the dispersion of step (2) and reacting until substantially all the isocyanate groups have reacted to form a fibrous thickener in situ.

13. The process of claim 12, wherein the weight ratio of diurea thickener formed in step (1) to insitu fibrous diurea thickener is from 1:1 to 1:19.

14. The process of claim 13, wherein there are substantially equal molar concentrations of toluene diisocyanate, cycloalkyl amine and fatty aliphatic amine in step (1) and substantially equal molar concentrations of toluene diisocyanate, alkylphenyl amine and fatty aliphatic amine in steps (2) and (3).

* * * * *